United States Patent [19]

Foubert

[11] Patent Number: 4,914,790

[45] Date of Patent: Apr. 10, 1990

[54] DEVICE FOR THE MOVABLE MOUNTING OF AN OBJECT, IN PARTICULAR OF A JEWEL ON A SUPPORT

[75] Inventor: Alain Foubert, Montigny-Les-Cormeilles, France

[73] Assignee: Cartier International B.V., Amsterdam, Netherlands

[21] Appl. No.: 316,619

[22] Filed: Feb. 28, 1989

[30] Foreign Application Priority Data

Feb. 29, 1988 [FR] France ..... 88 02449

[51] Int. Cl.[4] ..... A44B 11/25

[52] U.S. Cl. ..... 24/658; 24/616; 24/606

[58] Field of Search ..... 24/658, 615, 617, 616, 24/606

[56] References Cited

U.S. PATENT DOCUMENTS

| | | | |
|---|---|---|---|
| 468,677 | 2/1892 | Maxheimer et al. | 24/616 |
| 1,232,733 | 7/1917 | Swedlund | 24/616 |
| 2,676,822 | 4/1954 | Modrey | 24/606 |
| 3,611,513 | 10/1971 | Hoober | 24/658 |
| 4,426,854 | 1/1984 | Geldwerth et al. | 24/616 |
| 4,520,537 | 6/1985 | Valikov | 24/616 |

FOREIGN PATENT DOCUMENTS

| | | | |
|---|---|---|---|
| 938921 | 4/1965 | Fed. Rep. of Germany . | |
| 557510 | 4/1970 | Fed. Rep. of Germany . | |
| 2344741 | 3/1974 | Fed. Rep. of Germany . | |
| 201445 | 12/1959 | France . | |
| 325860 | 3/1963 | France . | |
| 0434066 | 8/1935 | United Kingdom | 24/616 |

*Primary Examiner*—Victor N. Sakran

*Attorney, Agent, or Firm*—Cushman, Darby & Cushman

[57] ABSTRACT

A device for releasable attachment of an object to a support member, such as a precious stone to a brooch or necklace, includes a first member for attachment to the object and having a releasable locking device and a second member for attachment to the support member and having a tab insertable into a slot of the first member to be engaged by the locking device to thereby releasably secure the first and second members together.

11 Claims, 2 Drawing Sheets

DEVICE FOR THE MOVABLE MOUNTING OF AN OBJECT, IN PARTICULAR OF A JEWEL ON A SUPPORT

BACKGROUND OF THE INVENTION

The present invention concerns a device for the movable mounting of an object on a support, and, more particularly, a device for the temporary mounting of a jewel as desired on a setting, when, for example, this setting is another jewel such as a necklace or a bracelet, or, in another arrangement, a jewel mounting device, for example, the mechanism on a brooch or earring.

The mounting of a jewel, especially of the foregoing types, on the surface of another piece of jewelry, for example a necklace, is well known.

However, the means provided for this purpose, for example a slide mount, a display mounting, or screw-based systems, are relatively impractical and, in addition, have only limited application. In fact, these means require delicate manipulation on the part of the user, who must sometimes employ a tool; above all, they do not permit the attached jewel to be used for any purpose other than the original one intended, for example, by mounting it on a brooch or by having the capacity to set the jewel in another place on the same mounting.

SUMMARY OF THE INVENTION

The present invention aims at the construction of a attachment device which is easy to manipulate and makes it possible to attach an object such as a jewel on a mounting in such a manner that it may be removed, while remaining reliably attached when mounted, i.e., with considerable security.

The attachment device according to the invention is characterized by the fact that it incorporates two elements which form one piece with, or may be attached to, the object and the support, respectively, with said elements having locking devices which work in conjunction with each other, in the form of at least one projecting tab on one of the elements which may be inserted into a corresponding slot on the other element, and a movable device on said other elements which may be engaged in a locked position in which said movable device works in conjunction with said tabs inserted into the corresponding slot in order to ensure the locked position and an unlocked position in which said movable device is detached from said tab or tabs.

In the following description, the element equipped with said projecting tab(s) will be called the male element, and the other element, that is, the element incorporating or attached to the gem or other type item, the removable device designed to operate in conjunction with said tab(s), the female element.

According to one particularly interesting feature of the invention, the device is constructed in such a way that the movement of the movable device toward the unlocked position occurs by exerting a tractive force outward on said movable device, preferably counter to the return force exerted by an elastic device, in particular a spring, mounted on said female element in such a way as to continuously draw said movable device into said locked position.

In one preferred embodiment, the female element has a receptacle containing an inner recess in which is mounted said movable device made in the form of a sliding tongue, an arrangement in which the tongue and the receptacle are provided with superimposable slots, whose number and size match the projecting tabs of the male element.

In an advantageous arrangement, the tab, or each of the multiple tabs projecting from the male element have a slot in which the movable device may be inserted, in particular by means of a coupling flange which is constituted by the rear edge of the corresponding slot in the movable device made in the form of a tongue.

Advantageously, the surface of the tab or of each of the tabs in which the slot opens out has a ramp-shaped profile, preferably curved, which makes locking possible when the male and female elements are brought together in such a way that they fit one over the other and catch. The ramp-shaped profile of the tab pushes the coupling flange of the tongue in a direction counter to the force exerted by its return spring, until said edge engages in the corresponding slot of the tab of the male element.

Advantageously, the female element incorporates, in addition, means which restrict the longitudinal motion of the movable, tongue-shaped device in the receptacle. The movable device has preferably in addition at its end a tab projecting toward the exterior of the receptacle, in order to facilitate gripping by the movable device for the purpose of its tractive movement, so as to accomplish the unlocking of the mechanism.

Furthermore, according to one feature peculiar to the invention, the female and male elements have, on at least one wall which in the locked position faces the wall of the other element, means for insertion which work in conjunction with each other, especially in the form of projections and corresponding openings, which contribute to the positioning and maintenance, particularly in the longitudinal sense, of the male and female elements.

Other advantages and features of the invention will emerge from the following description, which is provided as a non-limiting example and with reference to the attached drawings, in which:

FIG. 1 a schematic, perspective exploded view of the mechanism according to the invention before assembly;

Figure 1:
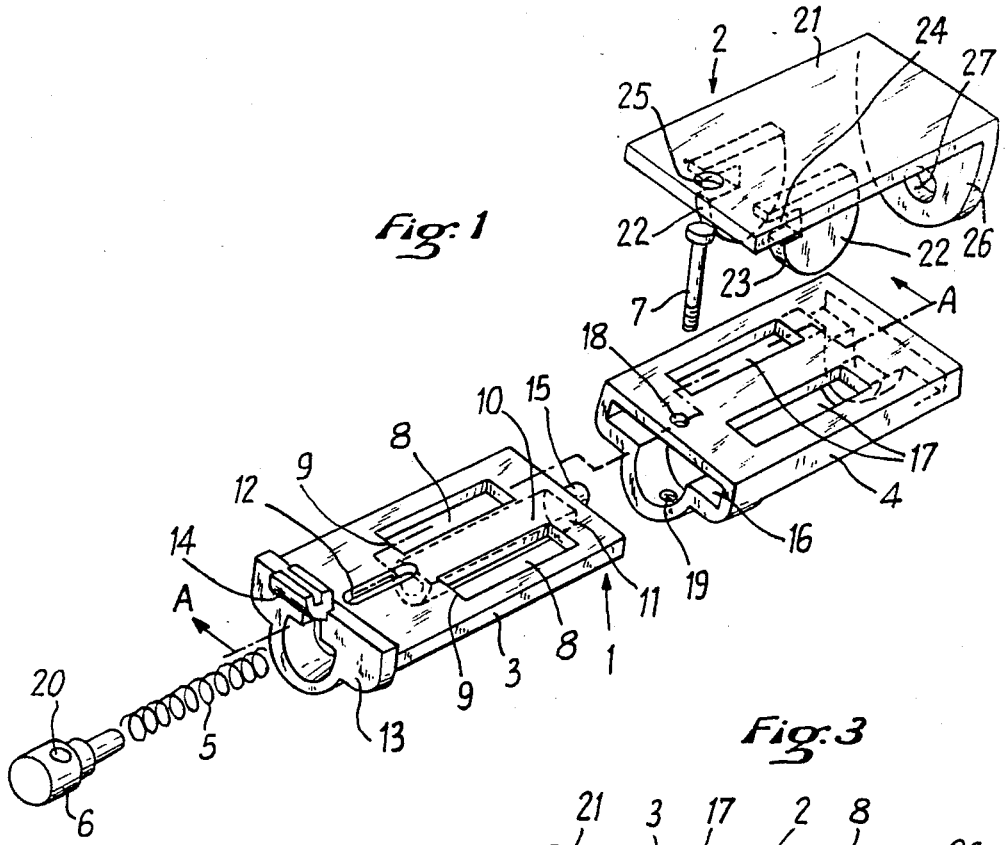

FIG. 1 shows a female element designated in its entirety by 1, and a male element designated by 2. The female element is actually composed of five parts designed to be assembled before assembly of the female element with the male element. When assembled for use, the female element 1 makes up a one-piece unit, as shown in FIGS. 2 through 4, on which the male element 2 is locked in place.

As shown in FIG. 1, the female element 1 contains a tongue-shaped device 3, a recessed receptacle 4 designed so that the tongue 3 may slide into it, a spring, in particular a helical spring 5, an end cap 6, and a rod, especially in the form of an assembly screw 7.

The tongue 3 has more or less the shape of a parallelepiped, and is equipped, in the illustrated example, with two slots 8, having a more or less rectangular section, which run along the tongue, and in which the parts of the tongue which compose the rear edges 9 of the slots 8 are designed to make up locking flanges, as will be explained below.

Figure 3:
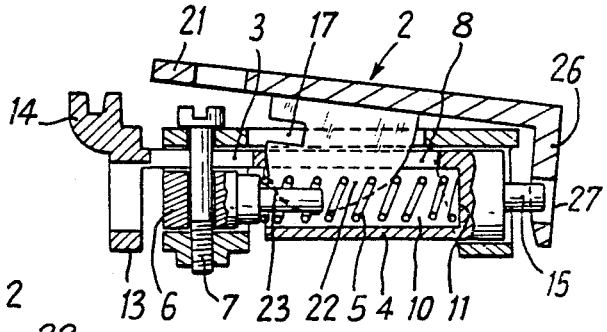
FIGS. 2–4 are sectional views of the mechanism along the line A—A of FIG. 1 during three phases of the installation and locking of the male and female elements.
Figure 2:
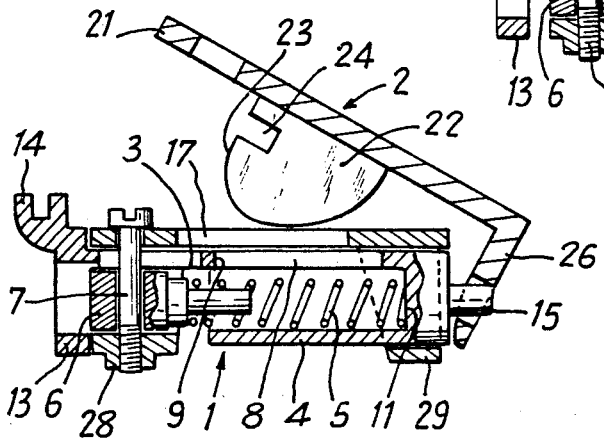
Figure 4:
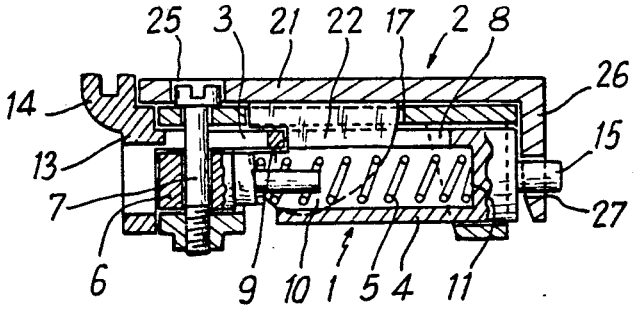

As a housing for the spring, the tongue 3 has, positioned in its medial axial portion, a hollow, tubular shaft 10 approximately cylindrical in shape; the spring 5 is housed inside of the shaft 10 and its front end comes to rest against a wall 11 which marks off the far end of the shaft 10, as is shown more clearly in FIGS. 2 through 4.

The tongue 3 has, furthermore, on its upper surface, an oblong opening 12 designed to limit the maximum amplitude of the movement of the tongue 3 in the receptacle 4.

Finally, the tongue 3 contains an end flange 13 equipped with a gripping hook or tab 14, on which the notch on the upper portion of the hook allows this hook to be grabbed, for example, by the fingernail of user in order to draw the tongue outward, as will be explained below.

Finally, in the illustrated example, the tongue 3 has, at its opposite end, a lug 15 projecting outward.

The receptacle 4 has an inner recessed area 16, whose shape and dimensions are adapted so as to receive the tongue 3 which slides into it.

The receptacle 4 has, on its upper surface, slots 17, which, in the illustrated example, are two in number. These slots have a section which is substantially rectangular.

To allow the passage of the assembly screw 7, the receptacle 4 incorporates, in addition, an orifice 18 in its upper surface and a threaded hole 19 in its lower part.

To allow passage of this assembly screw 7, there is also a hole 20 bored through the end-cap 6 which is set over the end of the screw which is opposite to the end resting against the far end of the shaft 10.

As FIGS. 2 through 4 show, the female element 1 is composed of a one-piece unit made up of the assembly of the parts 3, 4, 5, 6, and 7.

For this purpose, the assembly screw passes successively through the upper surface of the receptacle by passing through the orifice 18, the tongue 3 by passing through the oblong opening 12, the end-cap 6 by passing through the hole 20, and finally is inserted into the threaded hole 19 in the opposite surface of the receptacle 4; final assembly is achieved by tightening the screw. In the assembled position as shown in FIGS. 2 and 4, the tongue 3 is in the inserted position in the receptacle 4, with the rear edge 9 of the slots 8 on the tongue being moved forward axially, i.e., toward the right side of the drawing, in relation to the rear edge of the slots 17 of the receptacle 4.

It may be seen that, as a result of the specific assembly, the tongue 3 is always drawn toward the rightward position by the spring 5, with traction on the tongue being exerted in particular by a force exerted by the spring 5 pushing on the closed end of the shaft 10 which tends to move the tongue 3 leftwardly as viewed in FIG. 2 until the hook 14 on the flange 13 engages the end of receptacle 4, while a movement of the tongue toward the left side in the drawing occurs in a direction counter to that of the force exerted by the spring which, after release of the outward tractive force, naturally brings the tongue 3 back into the inserted position in the receptacle 4.

The maximum amplitude of the longitudinal displacement of the tongue 3 in the receptacle 4 is determined by the length of the oblong opening 12 in the tongue, through which the screw 7 forming one piece with the receptacle 4 passes.

The male element 2 of the mechanism according to the invention has the form of a substantially rectangular plate 21 , on one surface of which project two locking tabs 22 arranged as hooks and having one surface in the shape of a curved ramp 23 which ends in a slot 24 arranged parallel to the plane of the plate 21.

In the embodiment illustrated in FIGS. 1 through 4, the male element 2 has, furthermore, in the plate-shaped part 21, a hole 25 designed to hold the head of the screw 7 in place in the locked position represented in FIG. 4, and an end flange 26 perpendicular to the plate 21 and having an opening 27 designed to fit over the projecting lug 15 on the female element.

The mechanism according to the invention is operated in the following way.

The female element, composed of its five assembled components, is attached, in particular by soldering, to an object such as a jewel to be set on a support.

For this purpose, the female element 1 may be soldered in the area of the zones 28 and 29 projecting from its lower part into a hollowed area on the rear surface of the object, in particular the jewel (not shown) which is to be mounted. When used in this way, the female element will be permanently made unitary with the jewel, thereby allowing the jewel to be attached to any support whatever (not shown), on which a corresponding male element will have been attached or mounted.

When the male element represented in FIG. 1 is used, it must be attached, in particular by soldering, by the surface of the plate 21 which is opposite to the surface bearing the locking tabs 22, and/or by its flange 26, to a support, which may, for example, be a mounting device for a jewel such as a brooch or earring device.

Figure 5:
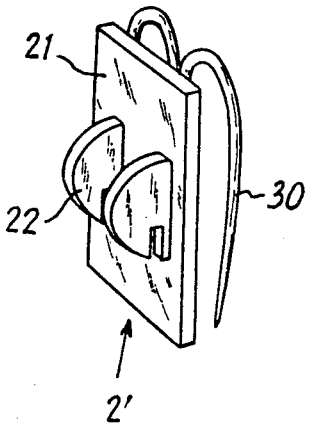

FIG. 5 thus illustrates a male element 2', on the rear surface of whose plate 21 a pair of curved pins 30 are soldered, making up a device for mounting a jewel as on a brooch mount.

The pins 30 may, of course, be replaced by any other jewel-mounting device, in particular another brooch or earring device, etc.

It will be understood that, in such an embodiment, a single jewel to which the female element of the mechanism according to the invention is attached, ma be mounted as desired interchangeably on various supports, and the same jewel may thus be worn in different ways as desired by the user.

Figure 6:
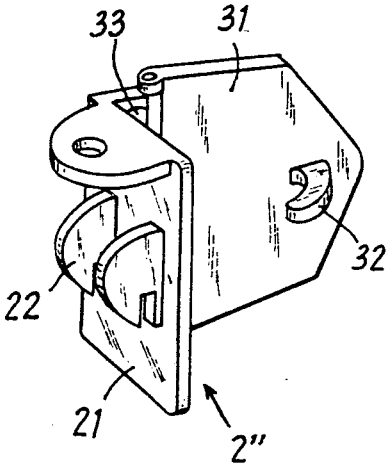
FIGS. 5 and 6 represent two other possible embodiments of the male element of the mechanism according to the invention.

As a result of the embodiment represented in FIG. 6, it is, furthermore, possible to mount the object, such as the jewel, attached to the female element in any location whatever of a support, such as, for example, a necklace or a bracelet.

In this embodiment, the male element 2'' has, jointed to the plate 21 equipped with the tabs 22, a flap 31 equipped with a gripping claw 32. By folding up the flap 31, the male element 2'' may thus be positioned on a bracelet, for example one made of articulated chain links, in such a way that the bracelet passes through a recess 33 arranged between the plate 21 and the flap 31 in the folded-down position It will be understood that, in this embodiment, the jewel to which the female element is attached may, furthermore, be mounted so as to be movable at will at any desired point on a support. Furthermore, using the male element 2'', different jewels, each attached to a female element, may be mounted interchangeably on the support.

Once the male and female elements have been positioned or attached, respectively, to the object and the matching support, the male and female elements are brought together as shown in FIG. 3.

When the flange 26 is provided, it is fitted by its orifice 27 on the lug 15 on the female element, so as to position the male element on the female element, after which pressure is applied from the top downward on the male element, so as to push away, as shown in FIG. 3, by means of the ramp-shaped parts 23 of the tabs 22, the coupling flanges 9 on the tongue 3, then permit the flanges 9 to be inserted by latching into the slots 24, by means of the return stress exerted by the spring 5 in order to be placed in the locked position shown in FIG. 4.

If desired, between the position shown in FIG. 2 and that shown in FIG. 3, traction directed outward may be exerted on the tongue to facilitate the insertion of the locking tabs in the corresponding slots on the tongue and the receptacle.

It will be understood that the mechanism according to the invention offers a large measure of security to the extent that, in the locked position illustrated in FIG. 4, this mechanism constitutes a compact unit, in which event the only stress capable of being exerted from the outside in order to unlock the mechanism is a tractive stress, which cannot be applied accidentally.

The proper positioning and locking of the male and female elements are, moreover, aided by the insertion of the lug 15 on the female element into the hole 27 on the flange 26 on the male element, and by the insertion of the head of the screw 7 of the female element in the hole 25 in the plate 21 of the male element.

Furthermore, in the event the mechanism, and especially the spring, is damaged, the female element may be easily disassembled without detaching it from the object to which it is fastened, by unscrewing the screw 7 so as to be able to remove the receptacle while the tongue 3 remains attached to the object, and to remove the end-cap 6 and the spring 5, in order to replace this latter component. The female element is then reassembled, as indicated previously.

Although the invention has been described in relation to specific embodiments, it is evident that it is in no way limited to them, and that numerous variations and modifications may be made without departing from either the scope or the spirit of the invention.

What is claimed is:

1. A device for providing for the removable attachment of an object to a support comprising a first and a second member, said first member having means for attachment to an object and said second member having means for attachment to a supporting object, said first member having slot means, said second member having tab means for insertion into said slot means, said first member having locking means for releasably engaging said tab means, said locking means being movable between a first position wherein said tab means is securely engaged by said locking means to hold said second member attached to said first member and a second position wherein said tab means is released to allow detaching of said second member from said first member, wherein said first member including elastic means for constantly urging said locking means toward said first position, said locking means including a tongue and said first member including a receptacle means having an interior slidably receiving a portion of said tongue, said slot means including a slot in said tongue and a slot in said receptacle means alignable with said slot of said tongue, said tab means being insertable through said slot of said receptacle and through said slot of said tongue, said tongue being inserted into the receptacle means when said locking means is in said first position.

2. The device of claim 1, wherein said slot means includes at least one edge and said locking means comprises said at least one edge, and said tab means includes a recess engageable by said at least one edge.

3. The device of claim 2, wherein said tab means includes a ramp shaped face on which said recess is located whereby, when said tab means in inserted into said slot means, said face will engage said edge and effect displacement of said locking means from said first to said second position until said recess is opposite said edge of said slot means whereupon said locking means will move from said second to said first position.

4. The device of claim 3, wherein said first member includes means limiting movement of said receptacle relative to said tongue.

5. The device of claim 4, wherein said limiting movement means comprises another slot in said tongue through which extends an anchoring shaft with said tongue sliding on said anchoring shaft.

6. The device of claim 1, wherein said first member has at one end a tab projecting outward to facilitate the gripping thereof.

7. The device of claim 6, wherein said first member includes a lug and said second member includes an aperture means for receiving said lug when said second member is attached to said first member.

8. The device of claim 1, wherein said means for attachment to an object comprise spaced surfaces for establishing a soldering attachment for the object.

9. The device of claim 1, wherein said means for attachment to a supporting object comprises a platform surface.

10. The device of claim 9, wherein said platform surface includes a brooch pin.

11. The device of claim 9, wherein said platform surface is hingedly connected to said second member to move between an open and closed position.

* * * * *